US006723141B1

(12) United States Patent
Kendall

(10) Patent No.: US 6,723,141 B1
(45) Date of Patent: Apr. 20, 2004

(54) ADDITIVE CONCENTRATION

(75) Inventor: David Roy Kendall, Chester (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/704,022

(22) Filed: Nov. 1, 2000

(30) Foreign Application Priority Data

Nov. 4, 1999 (EP) ..... 99308801

(51) Int. Cl.[7] ..... C10L 1/22
(52) U.S. Cl. ..... 44/387; 44/412
(58) Field of Search ..... 44/387, 412

(56) References Cited

U.S. PATENT DOCUMENTS 6,203,584 B1 * 3/2001 Fuentes-Afflick ..... 44/387

FOREIGN PATENT DOCUMENTS

| | | | |
|---|---|---|---|
| EP | 534551 | | 9/1992 |
| WO | 9112303 | * | 8/1991 |

* cited by examiner

*Primary Examiner*—Cephia D. Toomer

(57) ABSTRACT

The invention provides an additive concentrate which comprises an oil soluble hydrocarbyl poly(oxyalkylene) aminocarbamate having a number average molecular weight ($M_n$) in the range 600 to 10,000 having at least one basic nitrogen atom wherein said hydrocarbyl group contains 1–30 carbon atoms, and an oil soluble hydrocarbyl amine of formula R—$NH_2$ wherein R represents a group R' or a group R'—$CH_2$—, wherein R' represents a hydrocarbyl group having a number average molecular weight ($M_n$)in the range 750 to 6,000; a gasoline composition containing such additive concentrate; and its preparation; and a method of operating a spark-ignition engine using such gasoline composition.

22 Claims, No Drawings

ADDITIVE CONCENTRATION

FIELD OF THE INVENTION

The invention relates to additive concentrates, gasoline compositions containing additive concentrates, the preparation of gasoline compositions, and the operation of spark-ignition internal combustion engines.

BACKGROUND OF THE INVENTION

EP-A-534551 provides a gasoline composition comprising a major amount of a gasoline and from 5 ppmw to 1,000 ppmw based on the gasoline composition of a mixture of (a) an oil soluble polyamine selected from the group consisting of (i) an aliphatic alkylene polyamine containing at least one olefinic polymer chain attached to a nitrogen atom and/or a carbon atom of the alkylene radical(s) connecting the amino nitrogen atoms and said polyamine having a number average molecular weight in the range from 600 to 10,000, (ii) a Mannich polyamine comprising the condensation product of a high molecular weight sulphur-free alkyl-substituted hydroxyaromatic compound wherein the or each alkyl group has a number average molecular weight in the range from 600 to 10,000, an amine which contains an amino group having at least one active hydrogen atom, and an aldehyde, wherein the respective molar ratio of reactants is 1:0.1–10:0.1–10, and (iii) mixtures of (i) and (ii); and (b) an oil soluble hydrocarbyl poly(oxyalkylene) aminocarbamate having a number average molecular weight in the range from 600 to 10,000 having at least one basic nitrogen atom wherein said hydrocarbyl group contains from 1 to 30 carbon atoms, and wherein the weight ratio of said polyamine (a) to said hydrocarbyl poly(oxyalkylene) aminocarbamate (b) ranges from 3:1 to 1:2.

The aliphatic alkylene polyamines of type (a)(i) necessarily contain at least two amino nitrogen atoms. The general formula (I) for preferred polyamines as given on page 3, provides for the polyamine to be a diamine when x in the formula is zero. Exemplified in EP-A-534551 is a composition comprising an N-polyisobutenyl-N'-N'-dimethyl-1,3-diamino propane having a molecular weight of 1050 ($M_n$). There is no mention whatsoever in EP-A-534551 of an aliphatic alkylene additive of type(a)(i) having just one amino nitrogen atom.

WO91/12303 describes a fuel composition comprising a hydrocarbon boiling in the gasoline or diesel range and about 400 to 1,200 parts per million of a fuel additive composition comprising:

a) a dispersant comprising a hydrocarbyl poly (oxyalkylene) aminocarbamate having at least one basic nitrogen atom and an average molecular weight of about 1,000 to about 3,000;

b) an injector detergent comprising a branched chain hydrocarbyl amine having at least one basic nitrogen atom and an average molecular weight of about 300 to about 700, wherein the hydrocarbyl moiety is derived from polymers of $C_2$ to $C_6$ olefins;

c) a fuel demulsifier which is homogeneous with the other components of said fuel additive composition; and d) a natural or synthetic carrier fluid.

It is said that the fuel additive compositions will in general contain about 10 to 70 weight percent amino carbamate dispersant, about 1 to 10 weight percent of the hydrocarbyl amine injector detergent, about 0.5 to 5 weight percent of the fuel demulsifier and about 25 to 80 weight percent of the carrier fluid (page 12 lines 21 to 26).

On page 18, at lines 6 to 8, of WO 91/12303 it is indicated that the branched chain hydrocarbyl amine having an average molecular weight of about 300 to 700, will in general contain from about 20 to 40 carbon atoms, which corresponds to a molecular weight range from about 280 to about 560.

The molecular weight range of the branched chain hydrocarbyl amines is described as being narrow and peaked near the indicated molecular weight (page 18, lines 12–14). From this it can be deduced that the term "molecular weight" as used in WO 91/12303 means number average molecular weight ($M_n$)

While the amino component of the branched chain hydrocarbyl amines may be either a monoamine or a polyamine, and this component embodies a broad class of amines having from 1 to 10 amine nitrogen atoms and from 2 to 40 carbon atoms and with a carbon to nitrogen ratio of between about 1:1 and 10:1 (page 18, lines 16 to 12), it is specifically stated that a particularly preferred branched-chain hydrocarbyl amine is polyisobutylene diamine (page 19, lines 1 and 2).

Indeed the only hydrocarbyl amine injector detergent used in the working examples of WO 91/12303 is a polyisobutylene ethylene diamine prepared by the stepwise reaction of a $C_{30}$ polyisobutylene having a molecular weight of approximately 420 with chlorine and ethylene diamine (page 23, lines 21 to 27).

The favourable effect of using this hydrocarbyl amine injector detergent is demonstrated in Example 9, wherein a fuel additive composition containing this hydrocarbyl amine injector detergent is shown to contribute to the octane requirement of a gasoline composition significantly less than an additive composition comprising an additive package containing a heavy polybutene ethylene diamine made from a polybutene containing on average 100 carbons per molecule and having an average molecular weight of about 1450.

From the teaching of WO 91/12303 the person skilled in the art would be led to conclude that if an injector detergent is to be used in combination with a hydrocarbyl poly (oxyalkylene) aminocarbamate, it should have a relatively low molecular weight below about 700, and preferably about 420, and that it should desirably be a polyamine.

One important property for an additive concentrate to possess is storage stability over a broad range of temperatures, e.g. temperatures as low as −20° C. and as high as 40° C.

SUMMARY OF THE INVENTION

It has now surprisingly been found possible to prepare an additive concentrate containing an hydrocarbyl poly (oxyalkylene) aminocarbamate together with a relatively high molecular weight monoamine, resulting in advantageous storage stability characteristics when compared with similar concentrates based on hydrocarbyl polyamines (e.g. a concentrate corresponding to those in EP-A-534551)

Accordingly, the present invention provides an additive concentrate which comprises an oil soluble hydrocarbyl poly(oxyalkylene) aminocarbamate having a number average molecular weight ($M_n$) in the range 600 to 10,000 having at least one basic nitrogen atom wherein said hydrocarbyl group contains 1–30 carbon atoms, and an oil soluble hydrocarbyl amine of formula R—$NH_2$ wherein R represents a group R' or a group R'—$CH_2$—, wherein R' represents a hydrocarbyl group having a number average molecular weight ($M_n$) in the range 750 to 6,000.

DETAILED DESCRIPTION OF THE INVENTION

In the description which follows, all molecular weight values are number average molecular weights ($M_n$), unless otherwise indicated.

As described in EP-A-534551, the amine component of the oil soluble hydrocarbyl-terminated poly(oxyalkylene) aminocarbamate is preferably derived from a polyamine having from 2 to 12 amine nitrogen atoms and from 2 to 40 carbon atoms. The polyamine is preferably reacted with a hydrocarbyl poly(oxyalkylene) chloroformate to produce the hydrocarbyl poly(oxyalkylene) aminocarbamate component. The chloroformate is itself derived from hydrocarbyl poly(oxyalkylene) alcohol by reaction with phosgene. The polymer, encompassing diamines, provides the product poly (oxyalkylene) aminocarbamate with, on average, at least one basic nitrogen atom per carbamate molecule, i.e., a nitrogen atom titratable by strong acid. The polyamine preferably has a carbon-to-nitrogen ratio in the range from 1:1 to 10:1. The polyamine may be substituted with substituents selected from hydrocarbyl groups having from 1 to 10 carbon atoms, acyl groups having from 2 to 10 carbon atoms, and monoketone, monohydroxy, mononitro, monocyano, alkyl and alkoxy derivatives of hydrocarbyl groups having from 1 to 10 carbon atoms. It is preferred that at least one of the basic nitrogen atoms of the polyamine is a primary or secondary amino nitrogen. Examples of suitable polyamines are those described in U.S. Pat. No. 4,191,537.

Hydrocarbyl, as used in describing all the components of this invention, denotes an organic radical composed of carbon and hydrogen which may be aliphatic, alicyclic, aromatic or combination thereof, e.g., aralkyl. Preferably, the hydrocarbyl group will be relatively free of aliphatic unsaturation, i.e., ethylenic and acetylenic, particularly acetylenic unsaturation. The more preferred polyamine for the aminocarbamate component is a polyalkylene polyamine, including alkylenediamine, and including substituted polyamines, e.g., alkyl and hydroxyalkyl-substituted polyalkylene polyamine.

Preferably, the alkylene group contains from 2 to 6 carbon atoms, there being preferably from 2 to 3 carbon atoms between the nitrogen atoms. Examples of such polyamines include ethylenediamine, diethylene triamine, triethylene tetramine, dipropylene triamine, tetraethylene pentamine and pentaethylene hexamine. Among the polyalkylene polyamines, polyethylene polyamines and polypropylene polyamines containing 2–12 amine nitrogen atoms and 2–24 carbon atoms, are especially preferred, with the lower polyethylene/polypropylene polyamines, e.g. ethylenediamine and dipropylene triamine, being most preferred.

The hydrocarbyl-terminated poly(oxyalkylene) polymers which are utilised in preparing the aminocarbamates are monohydroxy compounds, e.g., alcohols, often termed monohydroxy polyethers, or polyalkylene glycol monocarbyl ethers, or "capped" poly(oxyalkylene) glycols, and are to be distinguished from the poly(oxyalkylene) glycols (diols), or polyols, which are not hydrocarbyl-terminated, i.e., are not capped. The hydrocarbyl-terminated poly(oxyalkylene) alcohols are produced by the addition of lower alkylene oxides, such as ethylene oxide, propylene oxide and butylene oxide to the hydroxy compound ROH under polymerisation conditions, wherein R is the hydrocarbyl group which caps the poly(oxyalkylene) chain. In the poly(oxyalkylene) component of the aminocarbamate, the group R will contain from 1 to 30 carbon atoms, preferably from 2 to 20 carbon atoms and is aliphatic or aromatic, i.e. an alkyl or alkylphenyl wherein the alkyl is a straight or branched-chain of from 1 to 24 carbon atoms. The oxyalkylene units in the poly (oxyalkylene) component preferably contain from 2 to 5 carbon atoms but one or more units of a larger carbon number may also be present. Each poly(oxyalkylene) polymer contains at least 5 oxyalkylene units, preferably 8 to 100 oxyalkylene units, more preferably 10 to 100 units and most preferably 10 to 25 such units. The poly(oxyalkylene) component is more fully described and exemplified in U.S. Pat. Nos. 4,191,537 and 4,197,409. The hydrocarbyl poly (oxyalkylene) aminocarbamate used in the compositions of the present invention is obtained by linking the amine component and the poly(oxyalkylene) component together through a carbamate linkage, i.e.,

—O—C(O)—N— wherein the oxygen may be regarded as the terminal hydroxyl oxygen of the poly(oxyalkylene) alcohol component, and the carbonyl group, —C(O)—, is preferably provided by a coupling agent, e.g., phosgene. In the preferred method of preparation the hydroxycarbyl poly (oxyalkylene) alcohol is reacted with phosgene to produce a chloroformate and the chloroformate is reacted with the polyamine. The carbamate linkages are formed as the poly (oxyalkylene) chains are bound to the nitrogen of the polyamine through the oxycarbonyl group of the chloroformate. Since there may be more than one nitrogen atom of the polyamine which is capable of reacting with the chloroformate, the aminocarbamate contains at least one hydrocarbyl poly(oxyalkylene) polymer chain bonded through an oxycarbonyl group to a nitrogen atom of the polyamine, but the carbamate may contain 1, 2 or more such chains. It is preferred that the hydrocarbyl poly (oxyalkylene) aminocarbamate product contains, on average, 1 poly(oxyalkylene) chain per molecule (i.e., is a monocarbamate), although it is understood that this reaction route may lead to mixtures containing appreciable amounts of di- or higher poly(oxyalkylene) chain substitution on a polyamine containing several reactive nitrogen atoms. Several especially preferred aminocarbamates are butyl-poly (oxyalkylene)-N-(2-aminoethyl) carbamate and alkyphenyl-poly(oxyalkylene)-N-(2-aminoethyl) carbamate. A particularly preferred to carbamate can be expressed by the following formula:

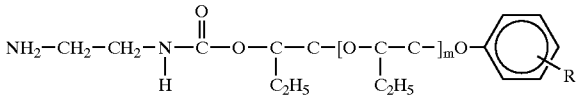

wherein R is a hydrogen atom or an alkyl group and m is greater than 5. Aminocarbamates suitable for use in the present invention can be obtained from the Oronite Additives Division of Chevron Chemical Company.

Synthetic methods to avoid higher degrees of substitution, methods of preparation, and other characteristics of the aminocarbamates used in the present invention are more fully described and exemplified in U.S. Pat. Nos. 4,191,537 and 4,197,409.

The number average molecular weight of the aminocarbamate will range from 600 to 10,000 ($M_n$), preferably from 600 to 5,000 ($M_n$) and most preferably from 600 to 2,000 ($M_n$)

In the oil soluble hydrocarbyl amine of formula R—$NH_2$, wherein R represents a group R' or a group R'—$CH_2$—, R' preferably represents a hydrocarbyl group having a number average molecular weight ($M_n$) in the range 900 to 3,000, more preferably in the range 950 to 2,000, and most preferably in the range 950 to 1,350. Hydrocarbyl amines wherein R' represents a hydrocarbyl group having a number average molecular weight ($M_n$) in the range 950 to 1,050 have been found to be very effective in the present invention.

The number average molecular weight, ($M_n$), of hydrocarbons, e.g. polyalkenes, may be determined by several techniques which give closely similar results. Conveniently, ($M_n$) may be determined for example by vapour phase osmometry (VPO) (ASTM D3592) or by modern gel permeation chromatography (GPC), e.g. as described for example in W. W. Yau, J. J. Kirkland and D. D. Bly, "Modern Size Exclusion Liquid Chromatography", John Wiley and Sons, New York, 1979.

Conveniently, the group R may represent a group R' or a group R'—$CH_2$—, wherein R' represents a polymeric substituent derived from alkanes or alkenes with straight or branched chains which may or may not have aromatic or cycloaliphatic substituents, for example groups derived from polymers or copolymers of olefins which may or may not have a residual double bond.

R' may advantageously represent a polymeric substituent derived from at least one olefinic monomer having from 2 to 6 carbon atoms. Preferred polymeric substituents are polyalkenyl substituents such as polyethenyl-, polypropenyl-, polybutenyl-, and polyisobutenyl-groups.

The hydrocarbyl amine of formula R—$NH_2$ may be prepared in known manner, e.g. by hydroformylation of a suitable olefin precursor followed by amination under hydrogenating conditions, e.g. in a manner analogous to that described in U.S. Pat. No. 4,832,702. U.S. Pat. No. 4,832,702 specifically discloses the preparation of polybutenyl- and polyisobutenyl amines from an appropriate polybutylene or polyisobutylene by hydroformylation and subsequent amination of the resulting oxo product under hydrogenating conditions.

The olefin precursor is preferably a polyolefin e.g. polyethylene, polypropylene, polybutylene or polyisobutylene. Preferred polyolefins are polyisobutylenes prepared from isobutene and up to 20% of n-butene.

The reactivity of a polyolefin depends upon the number and location of the olefinic double bonds in the molecule. Generally, a reactive polyolefin is one in which more than 10% of the double bonds are in an alpha position. While a wide range of polyolefins may suitably be used in the preparation of the hydrocarbyl amines of the present invention, it is preferred that the polyolefin employed is a reactive polyolefin, more preferably a highly reactive polyisobutylene.

The term "highly reactive polyisobutylene" has been defined in U.S. Pat. No. 5,916,825 (Column 3, lines 4 to 50). as referring to a polyisobutylene wherein greater than 70% of the residual olefinic double bonds are of the vinylidene type, i.e., represented by the formula:

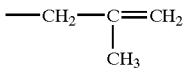

Examples of preferred polyisobutylenes are those obtainable from BP Amoco Ltd. under the trade mark "Ultravis", and BASF A.G. under the trade mark "Glissopal".

When the hydrocarbyl amine of formula R—$NH_2$ is prepared by a method analogous to U.S. Pat. No. 4,832,702, R represents a group R'—$CH_2$—, wherein R' preferably represents a polyalkenyl substituent. More preferably, when R represents R'—$CH_2$—, R' represents a polyisobutenyl substituent.

Hydrocarbyl amines especially suitable for use in the additive concentrates of the present invention are obtainable from BASF A.G. under the trade marks "Keropur" and "Kerocom".

The additive concentrate of the present invention may conveniently be prepared by admixing the oil soluble hydrocarbyl poly(oxyalkylene) aminocarbamate and the hydrocarbyl amine of formula R—$NH_2$. In the concentrate, the weight ratio of the hydrocarbyl poly(oxyalkylene) aminocarbamate to the hydrocarbyl amine of formula R—$NH_2$ is preferably in the range 6:1 to 1:6, more preferably in the range 3:1 to 1:3, even more preferably in the range 2:1 to 1:3, and most preferably in the range of 1:1 to 1:3. In an especially preferred additive concentrate the weight ratio is in the range 1:1 to 1:2.

In a preferred embodiment of the present invention, the concentrate may also contain an anti-corrosion agent. Suitable anti-corrosion agents include those commercially sold by Rhein Chemie, Mannheim, Germany as "RC 4801", or a polyhydric alcohol ester of a succinic acid derivative having on at least one of its alpha carbon atoms an unsubstituted or substituted aliphatic hydrocarbon group having from 20 to 500 carbon atoms, for example, pentaerythritol diester of polyisobutylene-substituted succinic acid, the polyisobutylene group having an average molecular weight of about 950.

An anti corrosion additive which may very conveniently be used in the additive concentrate of the present invention can be obtained from REChem A.G., Bern, Switzerland, under the designation "ER27".

The additive concentrate of the present invention may also contain other conventional additives including antioxidants such as phenolics, e.g. 2,6-di-tert-butylphenol or phenylenediamines, e.g. N,N'-di-sec-butyl-p-phenylenediamine, dyes, metal deactivators, and dehazers such as polyester-type ethoxylated alkylphenol-formaldehyde resins.

The additive concentrate of the present invention may further contain an amount of carrier fluid. Suitable carrier fluids, when utilized, include hydrocarbon based materials such as polyisobutylenes (PIB's), polypropylenes (PP's) and polyalphaolefins (PAO's), all of which may be hydrogenated or unhydrogenated but are preferably hydrogenated; polyether based materials such as polybutylene oxides (poly BO's), polypropylene oxides (poly PO's), polyhexadecene oxides (poly HO's) and mixtures thereof (i.e. both (poly BO)+(poly PO) and poly BO–(PO)); and mineral oils such as those sold by member companies of the Royal Dutch/Shell group under the designations "HVI" and "XHVI" (trade mark), Exxon Naphthenic 900 sus mineral oil and high viscosity index oils in general.

The additive concentrate of the present invention may further contain an amount of diluent.

Suitable diluents are hydrocarbons and mixtures of hydrocarbons with alcohols or ethers, such as methanol, ethanol, propanol, 2-butoxyethanol, methyl tert-butyl ether or higher alcohols such as "Dobanol 91" (Trade Mark) available from member companies of the Royal Dutch/Shell group.

Preferably the diluent is an aromatic hydrocarbon solvent such as toluene, xylene, mixtures thereof or mixtures of toluene or xylene with an alcohol. Additionally preferred diluents include "ShellsolAB", "ShellsolR", (Trade Marks) and low aromatic white spirit (LAWS), which are available from member companies of the Royal Dutch/Shell group.

It will be recognised that where the additive concentrate of the present invention contains a hydrocarbyl poly (oxyalkylene) aminocarbamate or hydrocarbyl amine component which has been obtained from a commercial supplier, that component may, in addition to the aminocarbamate or amine itself, contain a proportion of diluent and/or carrier fluid. The carrier fluid may take the form of unreacted intermediate from the manufacturing process, for example polyether in the case of the aminocarbamate, or polyisobutylene in the case where the amine is a polyisobutyl amine.

In the additive concentrates and gasoline compositions of the present invention, such proportions of diluent and/or carrier fluid are considered as being a part of the carrier fluid and/or diluent which the additive concentrate and compositions may additionally contain.

In the additive concentrates, the oil soluble hydrocarbyl poly(oxyalkylene) aminocarbamate is preferably present in an amount from 5% to 90% w, more preferably 10% to 60% w and most preferably 20% to 50% w, while the hydrocarbyl amine of formula R—$NH_2$ is preferably present in an amount from 5% to 95% w, more preferably 15% to 90% w, and most preferably 20% to 80% w, all percentages by weight being based upon the total weight of the concentrate.

When the concentrate additionally contains an anti-corrosion agent it is preferably present in an amount from 0.1% to 10% w, more preferably 0.1 to 5% w.

When the concentrate additionally contains an amount of carrier fluid and/or diluent, the amount of carrier fluid and/or diluent present is preferably in the range from 5 to 80% w, more preferably 10 to 70% w, and most preferably 20 to 60% w, based on the total weight of the concentrate.

The present invention also provides a gasoline composition comprising a major amount of a gasoline suitable for use in spark ignition engines, and a minor amount of additive concentrate according to the present invention. By a major amount of gasoline it is meant that more than 50% w of the composition is gasoline, while by minor amount of additive concentrate it is meant that less than 50% w of the composition is concentrate, the percentages by weight being based upon the total weight of the gasoline composition. Preferably, the minor amount of concentrate comprises less than 10% by weight of the gasoline composition.

In the gasoline composition of the present invention the weight ratio of the hydrocarbyl poly(oxyalkylene) aminocarbamate to the hydrocarbyl amine of formula R—$NH_2$ is preferably in the range of 6:1 to 1:6, more preferably in the range 3:1 to 1:3, even more preferably in the range 2:1 to 1:3, and most preferably in the range of 1:1 to 1:3.

The amount of hydrocarbyl poly(oxyalkylene) aminocarbamate in the gasoline composition is preferably in the range 25 to 2,500 ppmw (parts per million based on total weight of the fuel composition), more preferably in the range 50 to 1,000 ppmw, even more preferably in the range 50 to 500 ppmw and most preferably in the range 50 to 250 ppmw, based on total composition. The amount of hydrocarbyl amine of formula R—$NH_2$ in the gasoline composition is preferably in the range 25 to 2,500 ppmw, more preferably in the range 50 to 1,000 ppmw, even more preferably in the range 50 to 500 ppmw, and most preferably in the range 50 to 250 ppmw, based on total composition.

The hydrocarbyl poly(oxyalkylene) aminocarbamate and the hydrocarbyl amine of formula R—$NH_2$ are preferably present in the gasoline composition in a combined amount in the range of 50 to 5,000 ppmw, more preferably 100 to 1,000 ppmw and most preferably 100 to 500 ppmw, based on total composition.

When the gasoline compositions of the present invention additionally contain an anti-corrosion additive it is preferably present in an amount from 1 to 1,000 ppmw, more preferably 1 to 500 ppmw and most preferably 1 to 50 ppmw.

When the gasoline compositions additionally contain an amount of carrier fluid and/or diluent, the amount of carrier fluid and/or diluent present is preferably in the range from 50 to 5,000 ppmw, more preferably 100 to 1,000 ppmw, and most preferably 100 to 500 ppmw, based on total composition.

Typical gasolines suitable for use in spark ignition engines are mixtures of hydrocarbons having a boiling point in the range from 25° C. to 232° C. and comprise mixtures of saturated hydrocarbons, olefinic hydrocarbons and aromatic hydrocarbons. Preferred are gasoline blends having a saturated hydrocarbon content ranging from 40 to 80 percent volume, an olefinic hydrocarbon content ranging from 0 to 30 percent volume and an aromatic hydrocarbon content ranging from 10 to 60 percent volume. The base fuel can be derived from straight run gasoline, polymer gasoline, natural gasoline, dimer or trimerised olefins, synthetically produced aromatic hydrocarbon mixtures from thermally or catalytically reformed hydrocarbons, or from catalytically cracked or thermally cracked petroleum stocks, or mixtures of these. The hydrocarbon composition and octane level of the base fuel are not critical. The octane level, (R+M)/2, will generally be above 85. Any conventional base gasoline may be employed in the practice of this invention. For example, in the gasoline, hydrocarbons can be replaced by up to substantial amounts of conventional alcohols, or ethers, conventionally known for use in fuels. Alternatively, e.g. in countries such as Brazil, the "gasoline" may consist substantially of ethanol.

Preferably, the gasolines used in the present invention are lead-free, but can contain minor amounts of blending agents such as methanol, ethanol and methyl tertiary butyl ether e.g., from 0.1 to 15% volume of the base fuel. The gasolines themselves can also contain antioxidants such as phenolics, e.g., 2,6-di-tert-butylphenol or phenylenediamines, e.g., N,N'-di-sec-butyl-p-phenylenediamine, dyes, corrosion inhibitors, metal deactivators and dehazers such as polyester-type ethoxylated alkylphenol-formaldehyde resins. The gasolines may also contain antiknock compounds such as a methyl cyclopentadienylmanganese tricarbonyl and ortho-azidophenol as well as co-antiknock compounds such as benzoylacetone. Although the gasolines are preferably lead-free, gasolines containing tetraethyl lead or other lead-containing compounds, can be employed where permitted by law.

The present invention further provides a process for the preparation of a gasoline composition which comprises adding an additive concentrate according to the invention to a gasoline. The present invention further provides a method of operating a spark-ignition internal combustion engine which comprises introducing into the combustion chambers of said engine a gasoline composition according to the present invention.

The invention will be further understood from the following illustrative examples. In the examples the various additives are designated as follows:

(a) "OGA 480" contains a hydrocarbyl poly(oxyalkylene) aminocarbamate ($M_n$=1,400 to 1,800) and hydrocarbon solvent, approximately 50% w/w being volatile material. OGA 480 is obtainable from the Oronite Additives division of the Chevron Chemical Company. "OGA 499", obtainable from the same source as "OGA 480" is understood to contain essentially the same hydrocarbyl poly (oxyalkylene) aminocarbamate.

(b) "PIBA" is polyisobutylene monoamine (PIB-$CH_2$—$NH_2$), in which the polyisobutylene (PIB) chain has a number average molecular weight ($M_n$) of approximately 1,000, in the form of an approximately 50% w/w solution in hydrocarbon solvent of PIB-$CH_2$—$NH_2$. PIBA was obtained from BASF A.G. under the trade mark "Kerocom".

(c) "PIB-EDA" is a polyisobutylene ethylenediamine (N-polyisobutenyl-1,2-diaminoethane), in which the polyisobutylene chain has a number average molecular weight ($M_n$) of approximately 1,000, in the form of an approximately 55% w/w solution in xylene of polyisobutylene ethylenediamine.

(d) "PIB-DAP" is N-polyisobutenyl-N'-N'-dimethyl-1,3-diaminopropane, in which the polyisobutylene chain has a number average molecular weight ($M_n$) of approximately 1,000, in the form of an approximately 55% w/w solution in xylene of N-polyisobutenyl-N'-N'-dimethyl-1,3-diaminopropane.

In the examples which follow, amounts of PIBA, PIB-EDA and PIB-DAP are quoted as amounts of solution, and where amounts of solvent are quoted these do not include the solvent in solution.

(e) "ER27" is a proprietary anti-corrosion additive obtained under the designation "ER27" from REChem A.G. of Bern, Switzerland.

(f) "EP435" is a proprietary anti-corrosion and dehazer additive obtained under the designation "EP435" from REChem A.G. of Bern, Switzerland.

EXAMPLES 1–4

Additive concentrates in accordance with the invention were prepared by weighing the components into glass bottles in the order, xylene (if required), PIBA, and then OGA 480. The mixtures were shaken well. Samples of the resulting clear yellow additive concentrates were then placed in sealed 25 ml bottles and stored at temperatures of −20° C., ambient temperature (20° C.) and 40° C. for 6 weeks, after which stability was assessed visually. Comparative examples containing PIB-EDA (A–D) and PIB-DAP (E–H) were prepared and tested. Samples were weighed before and after testing to ensure there was no significant loss of volatiles. Results are given in Table 1.

In Table 1 a pass rating (P) indicates that after 6 weeks the additive concentrate remained clear and contained no more than 1 or 2 crystals. A fail rating (F) indicates that after 6 weeks phase separation had occurred or deposits had formed within the concentrate.

TABLE 1

| | Concentration (ppmw)[a] | | | | | | Stability | | |
|---|---|---|---|---|---|---|---|---|---|
| Example | OGA 480[b] | PIBA[c] | PIB-EDA[c] | PIB-DAP[c] | Xylene | Treat Rate ppmw | −20° C. | Ambient (20° C.) | 40° C. |
| 1 | 200 (100) | 200 (100) | 0 | 0 | 0 | 400 | P | P | P |
| 2 | 300 (150) | 100 (50) | 0 | 0 | 0 | 400 | P | P | P |
| 3 | 100 (50) | 300 (150) | 0 | 0 | 0 | 400 | P | P | P |
| 4 | 200 (100) | 200 (100) | 0 | 0 | 100 | 500 | P | P | P |
| Comp. A | 200 (100) | 0 | 200 (110) | 0 | 0 | 400 | F | F | F |
| Comp. B | 300 (150) | 0 | 100 (55) | 0 | 0 | 400 | F | F | F |
| Comp. C | 100 (50) | 0 | 300 (165) | 0 | 0 | 400 | F | F | F |
| Comp. D | 200 (100) | 0 | 200 (110) | 0 | 100 | 500 | P | F | F |
| Comp. E | 200 (100) | 0 | 0 | 200 (80) | 0 | 400 | P | F | F |
| Comp. F | 300 (150) | 0 | 0 | 100 (40) | 0 | 400 | P | F | F |
| Comp. G | 100 (50) | 0 | 0 | 300 (120) | 0 | 400 | P | F | F |
| Comp. H | 200 (100) | 0 | 0 | 200 (80) | 100 | 500 | P | F | F |

P = Pass; F = Fail.

[a]Based on the concentration that each component would have if the concentrate was blended into base fuel at the given treat rate.

[b]approximate amount of non-volatile material is shown in parenthesis.

[c]approximate amount of active matter is shown in parenthesis.

As can readily be observed, the additive concentrations of the invention, containing PIBA, had good storage stability at all the temperatures investigated. The comparative examples containing PIB-DAP were only stable at −20° C. Of the comparative examples containing PIB-EDA, only the additive diluted with xylene and stored at −20° C. was stable.

EXAMPLES 5–6

In a similar procedure to that of Examples 1–4, additive concentrates in accordance with the invention additionally containing a corrosion inhibitor, and comparative examples containing a combined corrosion/dehazer additive (I–J) were prepared.

The stabilities of the additive concentrates were tested in a similar manner to that described for Examples 1–4, except that the samples were assessed visually after 24 hours, 48 hours, 7 days and then every 7 days up to a maximum of 42 days. The concentrate of Example 4 was again tested. Results are given in Table 2.

TABLE 2

| | Concentration (ppmw)[a] | | | | | | | Stability | | |
|---|---|---|---|---|---|---|---|---|---|---|
| Example | OGA-480[b] | PIBA[c] | PIB-EDA[c] | ER27 | EP435 | XYLENE | Treat Rate ppmw | −20° C. | Ambient (20° C.) | +40° C. |
| 4 | 200 (100) | 200 (100) | 0 | 0 | 0 | 100 | 500 | P | P | P |
| 5 | 200 (100) | 200 (100) | 0 | 5 | 0 | 100 | 505 | P | P | P |
| 6 | 200 (100) | 200 (100) | 0 | 5 | 0 | 150 | 555 | P | P | P |
| Comp. I | 220 (110) | 0 | 170 (94) | 0 | 5 | 100 | 495 | F (35d) | F (7d) | F (14d) |
| Comp. J | 220 (110) | 0 | 170 (94) | 0 | 5 | 150 | 545 | F (35d) | F (7d) | F (14d) |

P = Pass: F = Fail: (35d) indicates the concentrate was considered to have failed after 35 days.
[a]Based on the concentration that each component would have if the concentrate was blended into base fuel at the given treat rate.
[b]approximate amount of non-volatile material is shown in parenthesis.
[c]approximate amount of active matter is shown in parenthesis.

Again, it can readily be seen that the additive concentrates of the invention had good storage stability over the full temperature range, while the comparative examples were not stable.

EXAMPLES 7–8

In order to carry out dehazing testing, additive concentrates in accordance with the invention and corresponding comparative concentrates containing PIB-EDA were dosed into unleaded gasoline containing no additives (base gasoline, 98 ULG). In these tests additive concentrate Comp, K corresponds to additive concentrate Comp. I of Table 2, omitting additive "EP435".

A dehazing test was carried out on the resulting fuel blends using modified dehazing test ASTM D1094. In this test a fuel blend is considered to have acceptable performance if the water volume is within +/−1 ml of its initial volume within 5 minutes, and the interface is clear (CL) with bubbles or a very slight film only. A pass rating in this test equates to a 1,1 rating in ASTM D1094. Results are given in Table 3, together with the fuel dosing treat rates.

TABLE 3

| Example (fuel blend) | Additive Concentrate | Treat Rate (ppmw) | Initial Vol (ml) | Rating (Volume (ml)/interface/ separation) | Pass/ Fail |
|---|---|---|---|---|---|
| 7 | 4 | 500 | 20 | 20/0/CL | P |
| 8 | 5 | 505 | 20 | 20/0/CL | P |
| Comp. L | Comp. K | 490 | 20 | 20/4/CL | F |
| Comp. M | Comp. J | 495 | 20 | 20/0/CL | P |

From Table 3 it can be seen that the fuel blends according to the invention passed the test without need of a dehazer additive, while in the absence of a dehazer additive the comparative fuel blend (Comp. L) failed the test, with an interface rating of 4, the presence of shred or scum being observed at the interface with light lace extending into the water phase.

EXAMPLES 9–10

The fuel blend of Example 7 and the fuel blend of comparative Example L were subjected to engine testing.

Toyota Clean Up

Inlet valve deposit (IVD) clean up tests were carried out in bench tests using a Toyota 2.0 liter 3S-FE engine having 4 valves per cylinder taken from a 1992 model Toyota Carina. The engine is multi point injected (MPI) and has a lambda sensor.

Before commencing the tests, inlet parts and combustion chambers were cleaned and new pre-weighed inlet valves and new spark plugs fitted, a new oil filter was fitted and the engine filled with new engine oil. In a first phase the engine was run on a base fuel for a period of 100 hours to build up engine deposits. The run comprised test cycles of 240 seconds, with each test cycle comprising 50 seconds of acceleration from 60 km/h to 100 km/h and 190 seconds of deceleration down to 60 km/h. The gear was fixed at $4^{th}$ gear for the duration of the test.

After this period, the engine was stripped and the valves re-weighed to give the IVD weight after the first fuel. The engine was then re-assembled and run on test fuel for a further period of 100 hours at the conditions described above. Upon completion, the valves were re-weighed and the weight loss measured to give the clean up (CU) performance, expressed as the percentage deposit removed.

Toyota 1JZ CCD

Combustion chamber deposit (CCD) tests were carried out using a Toyota 1 JZ engine, which is a 2.5 liter, 6 cylinder, engine having 4 valves per cylinder.

Before commencing the tests, inlet parts and inlet valves and combustion chambers were cleaned and new spark plugs fitted, a new oil filter was fitted and the engine filled with new engine oil.

The engine was run for a period of 70 hours under a test procedure corresponding to that of CEC-F-05-A-93, except that the Toyota 1 JZ engine was used in place of the Mercedes Benz M 102 E engine specified in the CEC-F-05-A-93 procedure.

Upon completion of the test, the deposits, which had formed in the combustion chambers were extracted and weighed to give the combustion chamber deposit (CCD) weight, expressed as mg/cylinder.

The results are displayed in Table 4. It can be seen that the fuel blend in accordance with the invention performs better than the comparative fuel blend in the CCD test, and in the IVD clean up test.

TABLE 4

| Example | Fuel Blend | Test | Units | Value |
|---|---|---|---|---|
| 9 | 7 | Toyota Clean Up | % CU (IVD) | 61 |
| 10 | 7 | Toyota 1JZ, CCD | mg/cylinder (CCD) | 918 |
| Comp. N | Comp. L | Toyota Clean Up | % CU (IVD) | 59 |
| Comp. O | Comp. L | Toyota 1JZ, CCD | mg/cylinder (CCD) | 1045 |

EXAMPLES 11–13

The fuel blend of Example 8 was subjected to a corrosion test via a modified procedure derived from ASTM D665 mod., and engine testing.

The modified corrosion test differed from the standard test (ASTM D665) in that it was carried out at ambient temperature (20 ° C.)and over a period of 5 hours.

Toyota Keep Clean

In order to evaluate inlet valve cleanliness, an IVD Keep-clean test was carried out using a Toyota 2.0 liter 3S-FE engine taken from a 1992 model Toyota Carina having 4 valves per cylinder. The engine is multi point injected (MPI), has a lambda sensor and exhaust gas recirculation.

Before commencing the test, inlet parts and combustion chambers were cleaned and new pre-weighed inlet valves and new spark plugs fitted to the engine, a new oil filter was fitted and the engine filled with new engine oil.

The engine was run for a period of 69 hours under a test procedure corresponding to that of CEC-F-05-A-93, except that the Toyota 3S-FE engine was used in place of the Mercedes Benz M 102 E engine specified in the CEC-F-05-A-93 procedure, and the torque values differ from those specified in CEC-F-05-A-93 to compensate for the different BMEP (break mean effective pressure) values achieved by the Mercedes Benz M 102 E and the Toyota 3S-FE engines.

The specific conditions of each cycle were:

| Stage | time (secs) | rpm | torque (Nm) |
|---|---|---|---|
| 1 | 30 | 850 | idle |
| 2 | 60 | 1300 | 26 |
| 3 | 120 | 1850 | 28 |
| 4 | 60 | 3000 | 30 |

Upon completion of the test, the engine was stripped and the valves re-weighed to give the inlet valve deposit (IVD) weight.

Vectra Valve Stick

A pair of 1.8 liter, throttle body injected Vauxhall Vectra cars having 2 valves per cylinder were used to evaluate valve sticking.

The two cars were first run for 60 miles around a test track on a base fuel to remove any traces of previous additive. Thereafter, the cars were run around a test track for 24 miles at speeds of up to 35 mph on additivated fuel, the cars were then parked in a freezer at −20° C. (+/−2° C.) for 12 hours with the engine compartments open to improve air circulation. After this time, the spark plugs were removed and, using a compression tester, the maximum pressure recorded in each cylinder as the engine is cranked over using the starter motor. Failure to develop a pressure indicates that an inlet valve is stuck open. Results are quoted as the average number of stuck open valves per car.

Results are given in Table 5.

TABLE 5

| Example | Fuel Blend | Test | Units | Value |
|---|---|---|---|---|
| 11 | 8 | Corrosion, (ASTM D655 mod.) | rating | no rust |
| 12 | 8 | Toyota Keep Clean | mg/valve (IVD) | 7 |
| 13 | 8 | Vectra @ −20° C. | average no. of stuck valves/per car | 0.5 |

The engine test results demonstrate that fuel blends in accordance with the invention have good performance with respect to inlet valve deposits and valve sticking. Gum is additive matter of low volatility that can not be evaporated off in tests such as ASTM D381. A very attractive feature of the additive concentrates of the present invention is their low gum content. For example, the additive concentrate of Example 5, which was blended into the fuel blend of Example 8, has a gum content of 16 mg/100 ml.

What is claimed is:

1. An additive concentrate comprising:

an oil soluble hydrocarbyl poly(oxyalkylene) aminocarbamate having a number average molecular weight ($M_n$) in the range 600 to 10,000 with at least one basic nitrogen atom wherein the hydrocarbyl substituent contains 1–30 carbon atoms; and, an oil soluble hydrocarbyl amine of formula R—$NH_2$ wherein R represents a group R' or a group R'—$CH_2$—, wherein R' represents a hydrocarbyl group having a number average molecular weight ($M_n$) in the range 750 to 6,000 wherein the aminocarbamate and the amine have a weight ratio in the range of 6:1 to 1:6.

2. The concentrate of claim 1, in which the weight ratio of the hydrocarbyl poly(oxyalkylene) aminocarbamate to the hydrocarbyl amine of formula R—$NH_2$ is in the range of 1:1 to 1:2.

3. The concentrate of claim 1, in which R' represents a hydrocarbyl group having a number average molecular weight ($M_n$) in the range 900 to 3,000.

4. The concentrate of claim 1, in which R' represent a polyalkenyl substituent.

5. The concentrate of claim 1, in which R' represents a polyisobutenyl substituent.

6. The concentrate of claim 1, further comprising an anti-corrosion additive.

7. A gasoline composition comprising:

a major amount of a gasoline suitable for use in a spark ignition engine; and, a minor amount of additive concentrate comprising:

an oil soluble hydrocarbyl poly(oxyalkylene) aminocarbamate having a number average molecular weight ($M_n$) in the range of 600 to 10,000 with at least one basic nitrogen atom wherein the hydrocarbyl substituent contains 1–30 carbon atoms; and, an oil soluble hydrocarbyl amine of formula R—$NH_2$ wherein R represents a group R' or a group R'—$CH_2$—, wherein R' represents a hydrocarbyl group having a number average molecular weight ($M_n$) in the range 750 to 6,000 wherein the aminocarbamate and the amine have a weight ratio in the range of 6:1 to 1:6.

8. The gasoline composition of claim 7 wherein the hydrocarbyl poly(oxyalkylene) aminocarbamate and the hydrocarbyl amine of formula R—$NH_2$ are present in a combined amount in the range 50 to 5,000 ppmw, based on total composition.

9. The gasoline composition of claim 8 in which the weight ratio of the hydrocarbyl poly(oxyalkylene) aminocarbamate to the hydrocarbyl amine of formula R—$NH_2$ is in the range of 1:1 to 1:2.

10. The gasoline composition of claim 9 in which R' represents a hydrocarbyl group having a number average molecular weight ($M_n$) in the range of 900 to 3,000.

11. The gasoline composition of claim 10 in which R' represents a polyalkenyl substituent.

12. The gasoline composition of claim 10 in which R' represents a polyisobutenyl substituent.

13. A process for the preparation of a gasoline composition which comprises:

adding to gasoline an additive concentrate comprising:

an oil soluble hydrocarbyl poly(oxyalkylene) aminocarbamate having a number average molecular weight ($M_n$) in the range of 600 to 10,000 with at least one basic nitrogen atom wherein the hydrocarbyl substituent contains 1–30 carbon atoms; and, an oil soluble hydrocarbyl amine of formula R—$NH_2$ wherein R represents a group R' or a group R'—$CH_2$—, wherein R' represents a hydrocarbyl group having a number average molecular weight ($M_n$) in the range 750 to 6,000 wherein the aminocarbamate and the amine have a weight ratio in the range of 6:1 to 1:6.

14. The process of claim 13 in which the hydrocarbyl poly(oxyalkylene) aminocarbamate and the hydrocarbyl amine of formula R—$NH_2$ are present in a combined amount in the range of 50 to 5,000 ppmw, based on total composition.

15. The process of claim 13 in which the weight ratio of the hydrocarbyl poly(oxyalkylene) aminocarbamate to the hydrocarbyl amine of formula R—$NH_2$ is in the range 1:1 to 1:2.

16. The process of claim 13 in which R' represents a polyalkenyl substituent.

17. The process of claim 13 in which R' represents a polyisobutenyl substituent.

18. A method of operating a spark-ignition internal combustion engine which comprises introducing into the combustion chambers of said engine a gasoline composition comprising:

a major amount of a gasoline suitable for use in a spark ignition engine; and, a minor amount of additive concentrate comprising:

an oil soluble hydrocarbyl poly(oxyalkylene) aminocarbamate having a number average molecular weight ($M_n$) in the range of 600 to 10,000 with at least one basic nitrogen atom wherein the hydrocarbyl substituent contains 1–30 carbon atoms; and, an oil soluble hydrocarbyl amine of formula R—$NH_2$ wherein R represents a group R' or a group R'—$CH_2$—, wherein R' represents a hydrocarbyl group having a number average molecular weight ($M_n$) in the range 750 to 6,000 wherein the aminocarbamate and the amine have a weight ratio in the range of 6:1 to 1:6.

19. The method of claim 18 in which the hydrocarbyl poly(oxyalkylene) aminocarbamate and the hydrocarbyl amine of formula R—$NH_2$ are present in a combined amount in the range 50 to 5,000 ppmw, based on total composition.

20. The method of claim 18 in which the weight ratio of the hydrocarbyl poly(oxyalkylene) aminocarbamate to the hydrocarbyl amine of formula R—$NH_2$ is in the range 1:1 to 1:2.

21. The method of claim 18 in which R' represents a polyalkenyl substituent.

22. The method of claim 18 in which R' represents a polyisobutenyl substituent.

* * * * *